United States Patent [19]

Sudweeks et al.

[11] Patent Number: 4,474,628

[45] Date of Patent: Oct. 2, 1984

[54] SLURRY EXPLOSIVE WITH HIGH STRENGTH HOLLOW SPHERES

[75] Inventors: Walter B. Sudweeks, Orem; Samuel O. Stock, West Jordan, both of Utah

[73] Assignee: IRECO Chemicals, Salt Lake City, Utah

[21] Appl. No.: 512,467

[22] Filed: Jul. 11, 1983

[51] Int. Cl.[3] ..... C06B 45/02

[52] U.S. Cl. ..... 149/21; 149/2; 149/46; 149/61; 149/76; 149/83; 149/110

[58] Field of Search ..... 149/2, 21, 46, 61, 76, 149/83, 110

[56] References Cited

U.S. PATENT DOCUMENTS 4,303,731 12/1981 Torobin ..... 149/2

*Primary Examiner*—Stephen J. Lechert, Jr.

[57] ABSTRACT

The present invention relates to improved explosives. More particularly, the invention relates to cap-sensitive slurry explosives, either water-in-oil emulsion explosives or conventional water-based slurries having a continuous aqueous phase, containing high strength, small, hollow, dispersed spheres as a density reducing agent. The preferred explosive is a cap-sensitive water-in-oil emulsion explosive having a water-immiscible liquid organic fuel as a continuous phase; an emulsified aqueous inorganic oxidizer salt solution as a discontinuous phase; an emulsifier; and as a density reducing agent, small, hollow, dispsersed spheres, preferably glass or plastic, having a strength such that a maximum of about 10% collapse under a pressure of 500 psi. As used herein, the term "cap-sensitive" means that the explosive composition is detonable with a No. 8 cap at 20° C. in a charge diameter of 32 mm or less.

10 Claims, No Drawings

SLURRY EXPLOSIVE WITH HIGH STRENGTH HOLLOW SPHERES

Conventional water-based slurry explosives having a continuous aqueous phase have been used for twenty or more years. See, for example, U.S. Pat. Nos. 3,249,474; 3,660,181 and 4,364,782. Water-in-oil emulsion explosives also are well-known in the art. See, for example, U.S. Pat. Nos. 4,356,044; 4,322,258; 4,141,767; 3,447,978 and 3,161,551. It generally has been considered necessary to add a density reducing agent to these types of explosives to render them cap-sensitive to detonation. Commonly used density reducing agents are air bubbles, gas bubbles produced in-situ chemically, and small, hollow, dispersed glass spheres. These kinds of density reducing agents are disclosed, for example, in U.S. Pat. No. 4,322,258. One problem with using air or gas bubbles is that they are compressible and may not provide sufficient density reduction under high pressures. Although glass spheres are incompressible to certain pressures, if crushed or broken by high pressures, they no longer provide the same level or type of density reduction. These high pressures can occur instantaneously in a phenomenon termed dead pressing.

Thus a major problem with explosives containing hollow spheres as a density reducing agent is that the spheres can collapse if the explosives experience dead pressing in a blasting application. Dead pressing is a form of shock wave desensitization wherein the shock wave from a detonated explosive charge impacts an adjacent undetonated charge and compresses it to above its critical density, or otherwise desensitizes it so that it fails to detonate upon initiation. Dead pressing can occur either of two ways. The charge can experience compression from the shock wave simultaneously with its attempted initiation, or the charge can be compressed by the shock wave prior to its attempted initiation. It has been found that unless the hollow spheres are of sufficient strength, they can collapse upon compression from the shock wave of a neighboring or adjacent detonation and thereby not provide sufficient density reduction of the explosive to enable it to detonate. Thus the explosive's density increases beyond its critical density (the maximum density a which a charge will detonate reliably with a No. 8 cap) and the charge fails.

The hollow spheres of the present invention have a strength sufficient to withstand or resist in some fashion the shock from a neighboring detonation, and thus they prevent the explosive from exceeding its critical density. This is of commercial significance in blasting applications where dead pressing otherwise would occur.

SUMMARY OF THE INVENTION

The invention comprises a cap-sensitive explosive which retains its sensitivity to detonation under high pressures through the use of high strength, small, hollow, dispersed spheres as a density reducing agent. Preferably, the explosive comprises a water-immiscible liquid organic fuel as a continuous phase; an emulsified aqueous inorganic oxidizer salt solution as a discontinuous phase; an emulsifier; and as a density reducing agent, small, hollow, dispersed spheres, preferably glass or plastic, having a strength such that a maximum of about 10% collapse under a pressure of 500 psi.

DETAILED DESCRIPTION OF THE INVENTION

Conventional aqueous slurry explosives, their compositions and methods of formulations, are well-known and are described in the references cited above. These explosives comprise a continuous phase of an aqueous inorganic oxidizer salt solution, a thickening agent for the solution, a particulate or liquid fuel and/or sensitizer, a density reducing agent and a cross-linking agent. The explosives are prepared by first forming a solution of the oxidizer salt and water (and miscible liquid fuel if any) at a temperature above the fudge point. The remaining ingredients are incorporated into and homogeneously dispersed throughout the solution by a mechanical stirring means as is known in the art. The description which follows deals with water-in-oil emulsion compositions, which are the preferred type of explosive for the present invention.

With respect to water-in-oil emulsion explosives, the immiscible liquid organic fuel forming the continuous phase of the composition is present in an amount of from about 3% to about 10% by weight of the total composition, and preferably in an amount of from about 4% to about 8%. The actual amount used can be varied depending upon the particular immiscible fuel(s) used and upon the presence of other fuels, if any. When the immiscible fuel(s) is used as the sole fuel (s), it is preferably used in amount of from about 4% to about 8% by weight. The immiscible organic fuels can be aliphatic, alicylic, and/or aromatic and can be saturated and/or unsaturated, so long as they are liquid at the formulation temperature. Preferred fuels include mineral oil, waxes, paraffin oils, benzene, toluene, xylenes, and mixtures of liquid hydrocarbons generally referred to as petroleum distillates such as gasoline, kerosene and diesel fuels. Particularly preferred liquid fuels are mineral oil, No. 2 fuel oil, paraffin waxes, microcrystalline waxes, and mixtures thereof. Aliphatic and aromatic nitro-compounds also can be used. Mixtures of the above can be used. Waxes must be liquid at the formulation temperature.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed below. These additional solid and/or liquid fuels can be added generally in amounts ranging up to 15% by weight. If desired, undissolved oxidizer salt can be added to the composition along with any solid or liquid fuels.

The inorganic oxidizer salt solution forming the continuous phase of the explosive generally comprises inorganic oxidizer salt in an amount from about 45% to about 90% by weight of the total composition and water and/or water-miscible organic liquids in an amount of from about 5% to about 20%.

The oxidizer salts are selected from the group consisting of ammonium, alkali and alkaline earth metal nitrates, chlorates and perchlorates. The preferred oxidizer salts are ammonium nitrate (AN), calcium nitrate (CN) and sodium nitrate (SN) and preferably a combination thereof. The total oxidizer salt employed is preferably from about 60% to about 86%.

Water generally is employed in an amount of from about 5% to about 20% by weight based on the total composition. It is preferably employed in an amount of from about 10% to about 16%. Water-miscible organic liquids can partially replace water as a solvent for the salts, and such liquids also function as a fuel for the composition. Moreover, certain organic liquids reduce the crystallization temperature of the oxidizer salts in solution. Miscible liquid fuels can include alcohols such as methyl alcohol, glycols such as ethylene glycols, amides such as formamide, and analogous nitrogen-containing liquids. As is well known in the art, the amount of type of liquid(s) used can vary according to desired physical properties.

The emulsifier can be selected from those conventionally employed, and various types are listed in the above-referenced patents. The emulsifier is employed in an amount of from about 0.2% to about 5% by weight. It preferably is employed in an amount of from about 1% to about 3%. Typical emulsifiers include sorbitan fatty esters, glycol esters, substituted oxazolines, alkyl amines or their salts, derivatives thereof and the like. Preferably the emulsifier contains an unsaturated hydrocarbon chain as its lipophilic portion, although the saturated form also can be used.

The basis of the present invention is the use of small, hollow, glass spheres as a density reducing agent. The spheres must have a strength sufficient to prevent or minimize dead pressing. This strength is such that a maximum of 10% of the spheres collapse under a pressure of 500 psi. (The percentage and pressure nominal values may vary±20%.) The spheres preferably are glass, although plastic spheres can be used. The spheres generally have a particle size such that 90% by volume are between 20 and 130 microns. High strength perlite spheres also can be used.

The spheres are employed in an amount sufficient to reduce the density of the explosive to within the range of from about 1.0 to about 1.35 g/cc. The explosives of the present invention are not cap-sensitive of densities at or near their natural densities, and thus the density reducing agent is used primarily to sensitize the explosive to detonation. When dead pressing occurs in water-in-oil emulsion compositions, the density of the explosive approaches its natural density and thus the explosive loses its cap-sensitivity. By using the high strength spheres of the present invention, any density increase is limited to an extend such that the explosive remains cap-sensitive.

Other density reducing means such as chemical gassing by conventional means can be employed in combination with the high strength spheres; however, chemical gassing, by itself, may not prevent dead pressing, particularly if dead pressing occurs at the instant of attempted initiation.

By weight, glass spheres preferably are employed in an amount of from about 1% to about 10%, depending on the sphere size and wall thickness. By volume, glass spheres preferably are employed to an amount of from about 5% to about 50%. These weights and volumes correspond to the above-stated density reduction range. The preferred glass spheres are those manufactured as "Glass Bubbles" by 3-M Company and designated as B23/500, B28/750, B37/2000 and B38/4000. These brands have respective strengths such that a maximum of about 10% will collapse at pressures of 500, 750, 2000 and 4000 psi, respectively. The preferred glass sphere is B23/500.

One of the main advantages of a water-in-oil explosive over a continuous aqueous phase slurry is that thickening and cross-linking agents are not necessary for stability and water resistance. However, such agents can be added if desired. The aqueous solution of the composition can be rendered viscous by the addition of one or more thickening agents and cross-linking agents of the type commonly employed in the art.

The water-in-oil emulsion explosives of the present invention may be formulated in a conventional manner. Typically, the oxidizer salt(s) first is dissolved in the water (or aqueous solution of water and miscible liquid fuel) at an elevated temperature of from about 25° C. to about 90° C., depending upon the crystallization temperature of the salt solution. The aqueous solution then is added to a solution of the emulsifier and the immiscible liquid organic fuel, which solutions preferably are at the same elevated temperature, and the resulting mixture is stirred with sufficient vigor to produce an emulsion of the aqueous solution in a continuous liquid hydrocarbon fuel phase. Usually this can be accomplished essentially instantaneously with rapid stirring. (The compositions also can be prepared by adding the liquid organic to the aqueous solution.) Stirring should be continued until the formulation is uniform. The spheres and other solid ingredients, if any, are then added and stirred throughout the formulation by conventional means. The formulation process also can be accomplished in a continuous manner as is known in the art.

It is advantageous to predissolve the emulsifier in the liquid organic fuel prior to adding the organic fuel to the aqueous solution. This method allows the emulsion to form quickly and with minimum agitation. The emulsifier can be added separately and just prior to emulsification, if the emulsifier would degrade at the elevated temperature of the fuel.

Sensitivity and stability of the water-in-oil emulsion compositions may be improved slightly by passing then through a high-shear system to break the dispersed phase into even smaller droplets prior to adding the density control agent.

Reference to the following tables further illustrates the invention.

In all of the examples in the tables, dead pressing distances are given. The dead pressing distances were obtained by suspending vertically parallel in water two identical charges and initiating one charge prior to the other. The dead pressing distances are the distances which separated the charges, with the first number indicating the distance at which a successful detonation of the delayed charge occurred, and the second number indicating the distance at which the delayed (250 milliseconds) charge failed. The shorter the distance for a successful detonation, the more resistant the explosive is to dead pressing.

In Example A, of Table I, the hollow glass spheres used had a strength of less than that required in the present invention. The C15/250 spheres that were used have a strength such that a maximum of about 10% collapse at a pressure of only 250 psi, rather than 500 psi as required in the present invention.

In comparison, Examples B and C both detonated successfully at a separation distance of 1.0 meter and thus were considerably more resistant to dead pressing than Example A. The glass spheres used in Examples B and C exceeded the minimum strength requirements of the present invention. The strengths of the spheres used in Examples B and C are such that a maximum of about 10% collapse under pressures of 750 and 4000 psi, respectively.

Examples D and E of Table I provide a direct comparison of identical formulations differing only in the type and thus strength of glass spheres used. Example D, which used the same C15/250 glass spheres as used in Example A, similarly dead pressed at 1.25 meters, whereas Example E, which used a B23/500 glass sphere (having a strength such that a maximum of about 10% collapse at a pressure of 500 psi), detonated successfully at 1.25 meters. Example F used the same strength glass spheres as used in Example E but at a higher level to give the same product density as in Example D for purposes of comparison.

Conventional water-based slurry explosives were tested and the results are shown in Table II. In Example A, the hollow glass spheres used (C15/250) had a strength of less than that required in the present invention. But Examples B and C, which had an identical formulation except for the type of hollow glass spheres, contained spheres of the required strength and as shown successfully at lesser separation distances than did Example A.

Example D of Table II shows a perchlorate-containing water-based slurry explosive which had a good resistance to dead-pressing due to the presence of high strength microballoons.

An examination of the charges which dead pressed and thus failed indicated that an appreciable amount of the glass spheres had broken or collapsed due to the shock wave from the adjacent charge. From the foregoing examples, it is seen that water-in-oil emulsion explosives and conventional slurry explosives of the type tested, and having glass spheres of sufficient strength such that a maximum of about 10% will collapse at pressures of 500 psi, will not dead press even at charge separation distances as low as 1.0 meters.

The compositions of the present invention can be used in the conventional manner. Although they normally are packaged, such as in cylindrical sausage form, in relatively small diameters, the compositions also can be loaded directly into boreholes as a bulk product. Thus the compositions can be used both as a small diameter and a large diameter product. The compositions generally are extrudable and/or pumpable with conventional equipment. The above-described properties of the compositions render them versatile and economically advantageous for most applications.

While the present invention has been described with reference to certain illustrative examples and preferred embodiments, various modifications will be apparent to those skilled in the art and any such modifications are intended to be within the scope of the invention as set forth in the appended claims.

Conventional water-based slurry explosives were tested and the results are in Example A, the hollow glass spheres used (C15/250) had a strength of less than that required in the present invention; but Examples B and C, which had an identical formulation except for the type of hollow glass spheres, contained spheres of the required strength and as shown detonated successfully at lesser separation distances than did Example A.

Example D shows a perchlorate-containing water-based slurry explosive which which had a good resistance to dead-pressing due to the presence of high strength microballoons.

TABLE I

| Composition Ingredients (parts by weight) | A | B | C | D | E | F |
|---|---|---|---|---|---|---|
| AN | 67.04 | 65.03 | 63.07 | 67.05 | 67.05 | 65.47 |
| CN | 12.73 | 12.35 | 11.97 | 12.74 | 12.74 | 12.44 |
| $H_2O$ | 11.21 | 10.87 | 10.54 | 11.21 | 11.21 | 10.95 |
| Emulsifier[a] | 1.40 | 1.36 | 1.32 | 1.04 | 1.04 | 1.02 |
| Liquid Organic[b] | 0.25 | 0.24 | 0.24 | 0.25 | 0.25 | 0.24 |
| Wax[c] | 3.87 | 3.75 | 3.66 | 4.23 | 4.23 | 4.13 |
| Spheres | 3.50[d] | 6.40[e] | 9.20[f] | 3.48[d] | 3.48[g] | 5.8[g] |
| Density (g/cc) | 1.07 | 1.08 | 1.09 | 1.10 | 1.18 | 1.10 |
| Detonation Results (5° C.) | | | | | | |
| Minimum Booster, 32 mm[h] | 5/4 | 6/5 | 8/6 | 6/5 | 8/6 | 6/5 |
| Detonation Velocity (km/sec) | — | — | — | 4.9 | 5.3 | 4.7 |
| Dead Pressing Distance (m)[i] | 1.50/1.25 | 1.00/— | 1.00/— | 1.5/1.25 | 1.25/1.0 | 1.0/— |

[a]2-(8-heptadecenyl)-4, 4-bis(hydroxymethyl)-2-oxazoline
[b]Mineral oil
[c]Microcrystalline wax
[d]C15/250 hollow glass spheres from 3-M Company
[e]B28/750 hollow glass spheres from 3-M Company
[f]B38/4000 hollow glass spheres from 3-M Company
[g]B23/500 hollow glass spheres from 3-M Company
[h]The first number indicates a detonation with the cap number listed. The second number indicates a failure with the cap number listed.
[i]The first number indicates a detonation at the charge separation distance listed. The second number indicates a failure at the charge separation distance listed.

TABLE II

| Composition Ingredients (Parts by Weight) | A | B | C | D |
|---|---|---|---|---|
| AN | 36.5 | 36.5 | 36.5 | — |
| CN | 29.8 | 29.8 | 29.8 | — |
| SN | 5.1 | 5.1 | 5.1 | — |
| $H_2O$ | 11.2 | 11.2 | 11.2 | 25.0 |
| Sodium Perchlorate | — | — | — | 49.3 |
| Thickener | 5.2[a] | 5.2[a] | 5.2[a] | 1.8[b] |
| Ethylene Glycol | 4.6 | 4.6 | 4.6 | 22.0 |
| Aluminum particles | 6.6 | 6.6 | 6.6 | — |
| Cross-linker[c] | 0.3 | 0.3 | 0.3 | 0.1 |
| Gilsonite | 0.4 | 0.4 | 0.4 | 0.1 |

TABLE II-continued

| Composition Ingredients (Parts by Weight) | A | B | C | D |
|---|---|---|---|---|
| Spheres | 2.5[d] | 3.8[e] | 6.3[f] | 6.1[e] |
| Density (g/cc) | 0.84 | 0.86 | 0.90 | 1.12 |
| Detonation Results (5° C.) | | | | |
| Minimum Booster, 32 mm | 3/2 | 3/2 | 3/2 | 3/2 |
| Dead Pressing Distance (m) | 2/1.75 | 1.5/1.25 | 1.25/1.0 | 1.5/1.25 |

[a]guar gum/starch 1.0/4.2
[b]substituted guar gum
[c]sodium dichromate solution
[d]C15/250 hollow glass spheres from 3-M Company
[e]B23/500 hollow glass spheres from 3-M Company
[f]B37/2000 hollow glass spheres from 3-M Company

We claim:

1. A cap-sensitive water-in-oil emulsion explosive which is resistant to dead pressing comprising a water immiscible liquid organic fuel as a continuous phase; an emulsified aqueous inorganic oxidizer salt solution as a discontinuous phase; an emulsifier; and as a density reducing agent, small, hollow, dispersed spheres having a strength such that a maximum of about 10% of the spheres by volume collapse under a pressure of 500 psi.

2. An explosive according to claim 1 wherein the spheres are glass.

3. An explosive according to claim 1 wherein the spheres are plastic.

4. An explosive according to claim 1 wherein the spheres are present in an amount sufficient to reduce the density of the explosive to within the range of from about 1.0 to about 1.35 g/cc.

5. An explosive according to claim 1 wherein the spheres are present in an amount of from about 1% to about 10% by weight, based on the total composition.

6. An explosive according to claim 4 wherein the spheres have a particle size such that 90% by volume are between 20 and 130 microns.

7. An explosive according to claim 1 wherein the liquid organic fuel is selected from the group consisting of mineral oil, waxes, benzene, toluene, xylene, and petroleum distillates such as gasoline, kerosene, and diesel fuels.

8. An explosive according to claim 1 wherein the inorganic oxidizer salt is selected from the group consisting of ammonium and alkali and alkaline earth metal nitrates, chlorates and perchlorates.

9. A cap-sensitive, water-in-oil emulsion explosive which is resistant to dead pressing comprising a water-immiscible liquid organic fuel as a continuous phase in an amount of from about 3% to about 10% by weight based on the total composition; an emulsified aqueous inorganic oxidizer salt solution as a discontinuous phase, comprising inorganic oxidizer salt in an amount of from about 45% to about 90% and water in an amount of from about 5% to about 20%; an emulsifier in an amount of from about 0.2% to about 5%; and as a density reducing agent, small, hollow, dispersed glass spheres having a strength such that a maximum of about 10% of the spheres by volume collapse under a pressure of 500 psi, in an amount sufficient to reduce the density of the explosive to within the range from about 1.0 to about 1.35 g/cc.

10. A cap-sensitive, aqueous slurry explosive comprising a continuous phase of aqueous inorganic oxidizer salt solution; cross-linking and thickening agents; particulate or liquid fuels and/or sensitizers; and as a density reducing agent, small, hollow, dispersed spheres having a strength such that a maximum of about 10% of the spheres by volume collapse under a pressure of 500 psi.

* * * * *